US011761634B2

(12) United States Patent
Prociw et al.

(10) Patent No.: US 11,761,634 B2
(45) Date of Patent: Sep. 19, 2023

(54) FUEL INJECTOR ASSEMBLIES

(71) Applicant: Delavan Inc., West Des Moines, IA (US)

(72) Inventors: Lev A. Prociw, Johnston, IA (US); Jason A. Ryon, Carlisle, IA (US); Jacob Greenfield, Granger, IA (US)

(73) Assignee: Collins Engine Nozzles, Inc., Des Moines, IA (US)

( * ) Notice: Subject to any disclaimer, the term of this patent is extended or adjusted under 35 U.S.C. 154(b) by 0 days.

(21) Appl. No.: 17/080,796

(22) Filed: Oct. 26, 2020

(65) Prior Publication Data

US 2021/0041105 A1 Feb. 11, 2021

Related U.S. Application Data

(62) Division of application No. 15/844,216, filed on Dec. 15, 2017, now Pat. No. 10,830,446.

(51) Int. Cl.

| | |
|---|---|
| ***F23R 3/36*** | (2006.01) |
| ***F23D 17/00*** | (2006.01) |
| ***F23R 3/28*** | (2006.01) |

(52) U.S. Cl.

CPC ..... *F23R 3/36* (2013.01); *F23D 17/002* (2013.01); *F23R 3/283* (2013.01);

(Continued)

(58) Field of Classification Search

CPC ..... F23R 3/286; F23R 3/46; F23R 3/34–346; F23R 3/36; F23R 2900/00017; F23D 17/002; F23D 2204/10

See application file for complete search history.

(56) References Cited

U.S. PATENT DOCUMENTS

| | | | |
|---|---|---|---|
| 4,977,740 | A | 12/1990 | Madden et al. |
| 5,426,933 | A | 6/1995 | Maden et al. |

(Continued)

FOREIGN PATENT DOCUMENTS

| | | | |
|---|---|---|---|
| EP | 2525152 | A2 | 11/2012 |
| EP | 3156732 | A1 | 4/2017 |
| GB | 2459771 | A | 11/2009 |

OTHER PUBLICATIONS

Extended European Search Report, of the European Patent Office, dated Feb. 21, 2019, issued in corresponding European Patent Application No. 18213020.3.

*Primary Examiner* — Gerald L Sung
*Assistant Examiner* — Rene D Ford
(74) *Attorney, Agent, or Firm* — Locke Lord LLP; Daniel J. Fiorello; Gabrielle L. Gelozin

(57) ABSTRACT

A method for assembling a fuel distribution system for a turbomachine fuel injector includes inserting a liquid fuel distributor into an interior cavity of a shroud to create a liquid fuel distribution circuit between the liquid fuel distributor and the shroud and inserting a gas fuel distributor into the interior cavity of the shroud and into an interior cavity of the liquid fuel distributor to create a gas fuel distribution circuit between the gas fuel distributor and the liquid fuel distributor. The method includes inserting a fuel transfer tube into an outer diameter of the shroud. The method includes brazing or shrink fitting at least one of the fuel transfer tube, the gas fuel distributor, or the liquid fuel distributor to the shroud.

8 Claims, 5 Drawing Sheets

(52) U.S. Cl.
CPC ..... *F23D 2204/10* (2013.01); *F23D 2213/00* (2013.01); *F23D 2900/00008* (2013.01); *F23K 2300/20* (2020.05); *F23R 2900/00017* (2013.01)

(56) References Cited

U.S. PATENT DOCUMENTS

| | | | | |
|---|---|---|---|---|
| 5,826,423 | A | 10/1998 | Lockyer et al. | |
| 6,363,725 | B1 | 4/2002 | Mei et al. | |
| 6,427,930 | B1 | 8/2002 | Mei et al. | |
| 8,661,824 | B2 | 3/2014 | Pelletier et al. | |
| 2009/0140073 | A1* | 6/2009 | Thomson | F23R 3/28 239/128 |
| 2012/0047903 | A1 | 3/2012 | Williams et al. | |
| 2015/0253009 | A1* | 9/2015 | Bandaru | F23R 3/36 60/740 |
| 2015/0253010 | A1 | 9/2015 | Schlein | |
| 2016/0116168 | A1 | 4/2016 | Bandaru et al. | |

* cited by examiner

FUEL INJECTOR ASSEMBLIES

CROSS-REFERENCE TO RELATED APPLICATION

This application is a divisional application of U.S. patent application Ser. No. 15/844,216 filed on Dec. 15, 2017, which is incorporated herein by reference in its entirety.

BACKGROUND

1. Field

The present disclosure relates to turbomachines, more specifically to fuel injector systems for turbomachines (e.g., industrial turbomachines).

2. Description of Related Art

Fuel injectors capable of injecting either or both of liquid or gas fuel and producing low NOx emissions can be retrofit into existing engines. Such fuel injectors can include complex construction and difficult methods of making such assemblies.

Such conventional methods and systems have generally been considered satisfactory for their intended purpose. However, there is still a need in the art for improved fuel injector systems. The present disclosure provides a solution for this need.

SUMMARY

In accordance with at least one aspect of this disclosure, a method for assembling a fuel distribution system for a turbomachine fuel injector includes inserting a liquid fuel distributor into an interior cavity of a shroud to create a liquid fuel distribution circuit between the liquid fuel distributor and the shroud and inserting a gas fuel distributor into the interior cavity of the shroud and into an interior cavity of the liquid fuel distributor to create a gas fuel distribution circuit between the gas fuel distributor and the liquid fuel distributor. The method includes inserting a fuel transfer tube into an outer diameter of the shroud, the fuel transfer tube including a liquid fuel channel configured to be in fluid communication with the liquid fuel distribution circuit and a gas fuel channel configured to be in fluid communication with the gas fuel distribution circuit. The method includes brazing or shrink fitting at least one of the fuel transfer tube, the gas fuel distributor, or the liquid fuel distributor to the shroud.

The method can include press fitting at least one of the liquid fuel distributor or the gas fuel distributor to the shroud. Press fitting can include heating the shroud before inserting the liquid fuel distributor so that the liquid fuel distributor can be inserted and cooling the shroud after inserting the liquid fuel distributor. Press fitting can include heating the liquid fuel distributor and the shroud before inserting the gas fuel distributor so that the gas fuel distributor can be inserted and cooling the liquid fuel distributor and the shroud after inserting the gas fuel distributor.

The method can further include applying a braze material to at least one of the liquid fuel distributor, gas fuel distributor, or the fuel transfer tube before inserting into the shroud. Applying braze material can include applying braze material at a predetermined location to create one or more braze joints.

In accordance with at least one aspect of this disclosure, a fuel injector fuel distributor system can include a shroud defining an interior cavity and a liquid fuel distributor defining a second interior cavity disposed within an interior cavity of the shroud. The liquid fuel distributor is configured to form a liquid fuel distribution circuit between the shroud and the liquid fuel distributor. The system includes a gas fuel distributor disposed within the interior cavity of the shroud and at least partially within the second interior cavity of the liquid fuel distributor. The gas fuel distributor is configured to form a gas fuel distribution circuit between the liquid fuel distributor and the gas fuel distributor. The system also includes a fuel transfer tube including a liquid fuel channel configured to be in fluid communication with the liquid fuel distribution circuit and a gas fuel channel configured to be in fluid communication with the gas fuel distribution circuit. At least one of the liquid fuel distributor, the gas fuel distributor, or the fuel transfer tube is brazed or shrink fit to the shroud.

The liquid fuel distributor, the gas fuel distributor, and the fuel transfer tube can all be brazed to the shroud. The gas fuel distributor and the liquid fuel distributor can be press fit to the shroud. In certain embodiments, the gas fuel distributor can be press fit to the liquid fuel distributor. The liquid fuel distributor and the gas fuel distributor is positioned upstream of a combustor shroud, the combustor shroud forming a combustion chamber. The shroud and the combustor shroud form an annular wall enclosing the liquid fuel distributor, the gas fuel distributor, and the combustion chamber. The fuel transfer tube extends through an outer diameter wall of the annular wall.

In accordance with at least one aspect of this disclosure, a fuel injector for a turbomachine includes a fuel injector fuel distributor system as described above. The turbomachine fuel injector can be for an industrial turbomachine or any other suitable turbomachine. In certain embodiments, the fuel injector can include a first fuel distributor (e.g., a primary) and a second fuel distributor (e.g., a secondary). The fuel injector of the fuel injector distributor device extends through the outer diameter wall of the annular wall.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
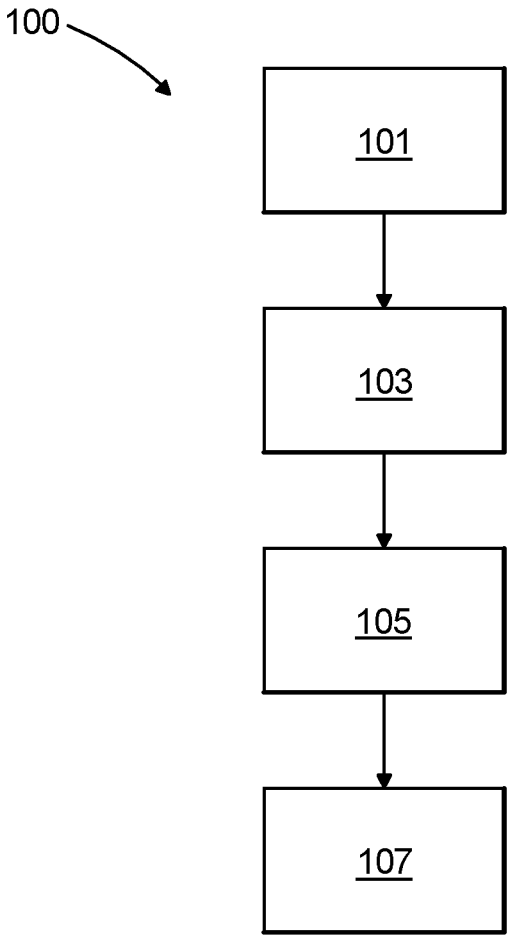
FIG. 1 is a flow diagram of an embodiment of a method in accordance with this disclosure.
Figure 2:
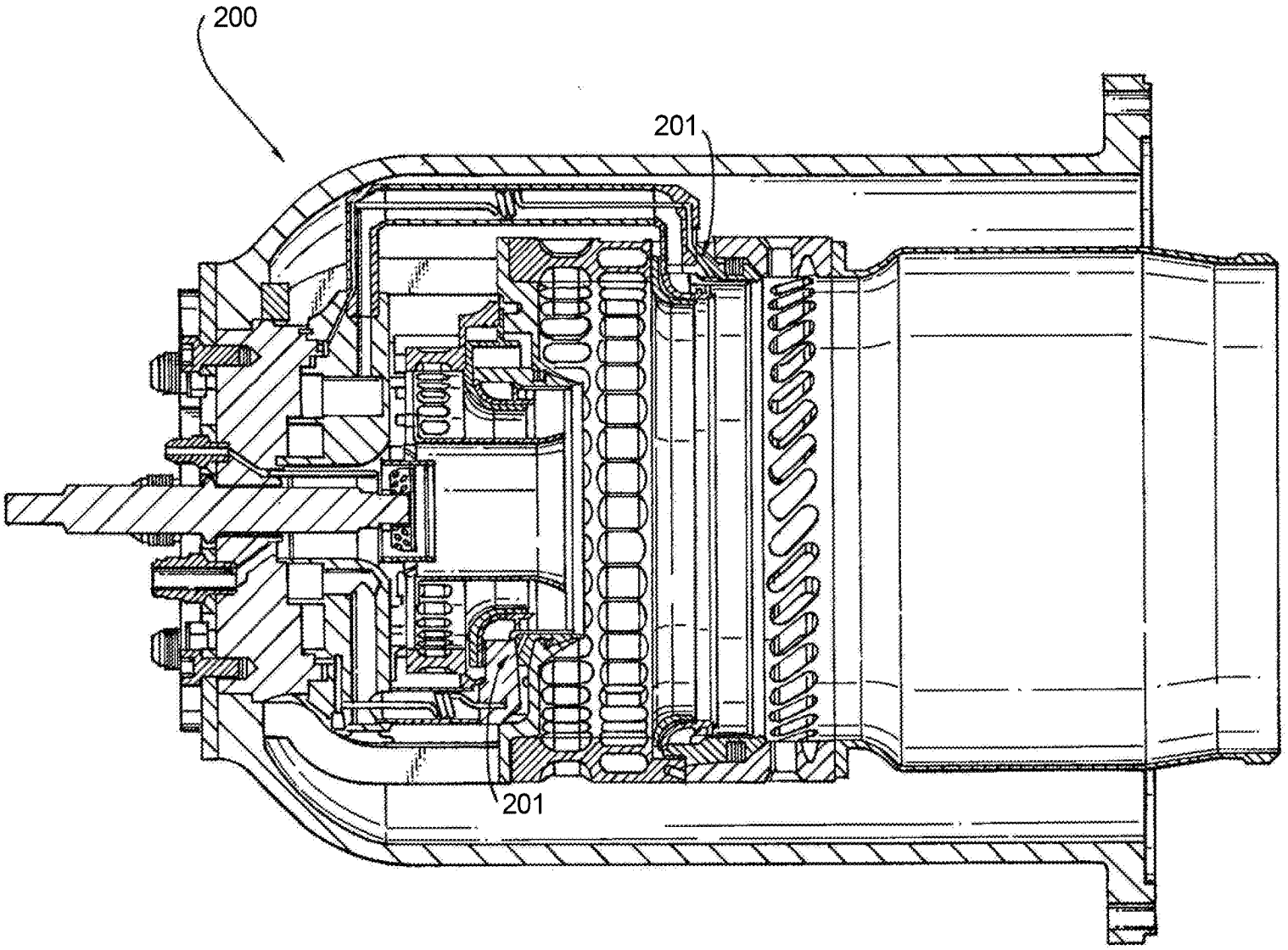
FIG. 2 is a cross-sectional view of an embodiment of a fuel injector in accordance with this disclosure.
Figure 3:
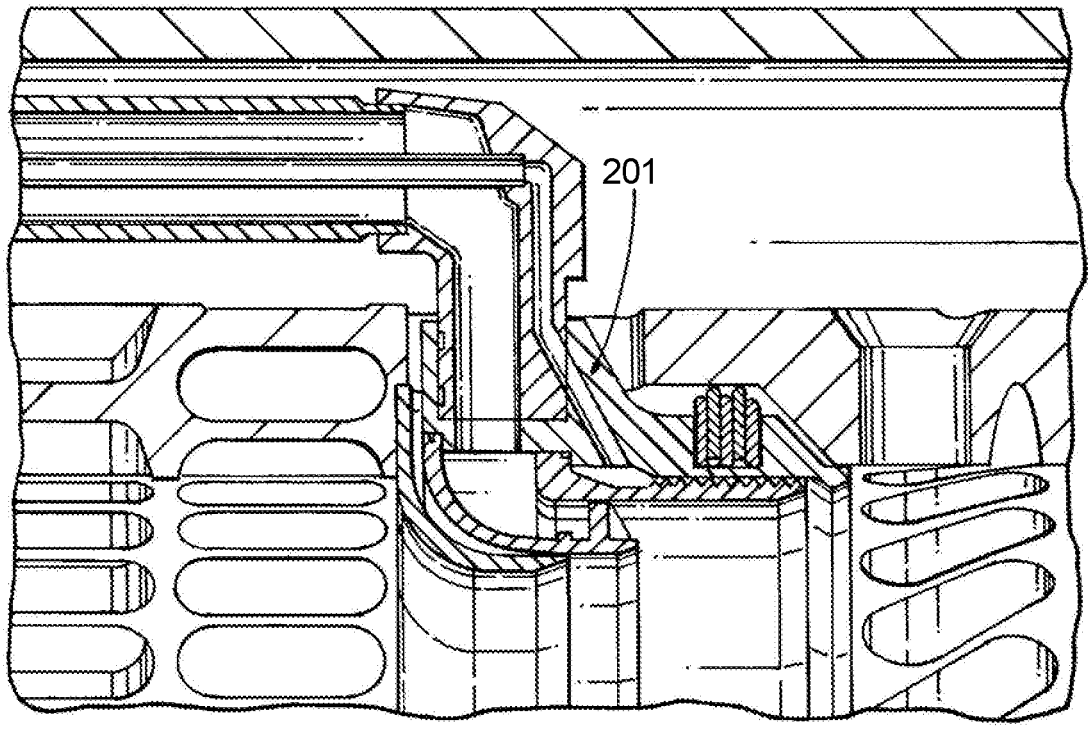
FIG. 3 is a partial cross-sectional view of the embodiment of FIG. 2.

Reference will now be made to the drawings wherein like reference numerals identify similar structural features or aspects of the subject disclosure. For purposes of explanation and illustration, and not limitation, an illustrative view of an embodiment of a method in accordance with the disclosure is shown in FIG. 1 and is designated generally by reference character 100. Other embodiments and/or aspects of this disclosure are shown in FIGS. 2-4B.

Referring to FIGS. 1-4B, a method 100 for assembling a fuel distribution system 201 for a turbomachine fuel injector 200 includes inserting 101 a liquid fuel distributor 203 into an interior cavity 207 of a shroud 205 to create a liquid fuel distribution circuit 209 between the liquid fuel distributor 203 and the shroud 205. The method 100 includes inserting 103 a gas fuel distributor 211 into the interior cavity 207 of the shroud 205 and into an interior cavity 213 of the liquid fuel distributor 203 to create a gas fuel distribution circuit 215 between the gas fuel distributor 211 and the liquid fuel distributor 203.

The method 100 includes inserting 105 a fuel transfer tube 217 into an outer diameter 219 of the shroud 205. The fuel transfer tube 217 includes a liquid fuel channel 221 configured to be in fluid communication with the liquid fuel distribution circuit 209 (e.g., through a channel 222 in the shroud 203 as shown) and a gas fuel channel 223 configured to be in fluid communication with the gas fuel distribution circuit 215.

The method 100 also includes brazing or shrink fitting 107 at least one of the fuel transfer tube 217, the gas fuel distributor 211, or the liquid fuel distributor 203 to the shroud 205. In certain embodiments, brazing 107 can include heating the fuel distribution system 201 to about 2000 degrees Fahrenheit or higher.

In certain embodiments, the method 100 can include press fitting at least one of the liquid fuel distributor 203 or the gas fuel distributor 211 to the shroud 205. Press fitting can include heating the shroud 205 (e.g., to about 500 degrees Fahrenheit) before inserting the liquid fuel distributor 203 so that the liquid fuel distributor 203 can be inserted and cooling the shroud after inserting the liquid fuel distributor 203. Press fitting can include heating the liquid fuel distributor 203 and the shroud 205 before inserting the gas fuel distributor 211 so that the gas fuel distributor 211 can be inserted and cooling the liquid fuel distributor 203 and the shroud 205 after inserting the gas fuel distributor 211.

The method 100 can further include applying a braze material (not shown) to at least one of the liquid fuel distributor 203, gas fuel distributor 211, or the fuel transfer tube 217 before inserting into the shroud 203. Applying braze material can include applying braze material at a predetermined location to create one or more braze joints 225 as shown in FIG. 4B. For example, a base portion and/or of the liquid fuel distributor 203 and/or the gas fuel distributor 211 can be brazed where it contacts the shroud 205. The braze material can be any suitable braze material as appreciated by those having ordinary skill in the art.

Figure 4A:
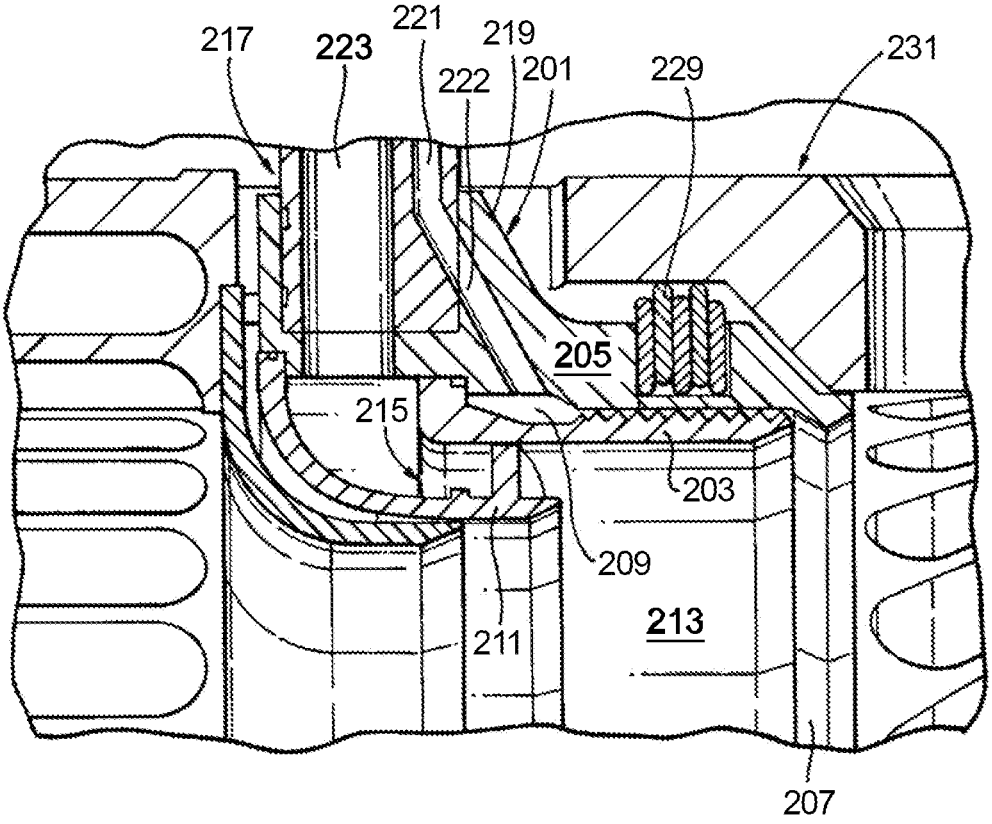
FIG. 4A is a zoomed partial cross-sectional view of the embodiment of FIG. 3, partially showing an embodiment of a fuel distribution system in accordance with this disclosure.
Figure 4B:
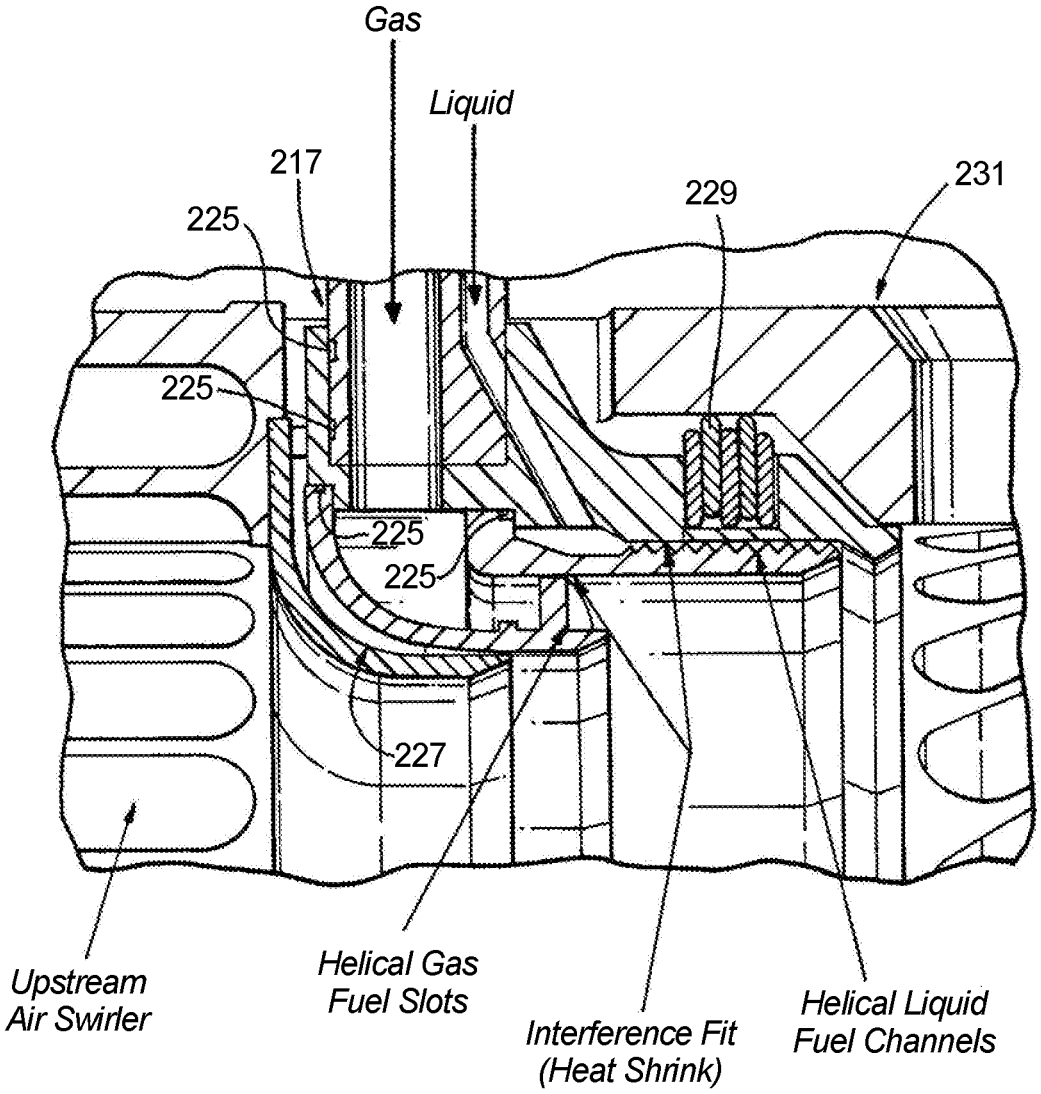
FIG. 4B is a partial cross-sectional view of the embodiment of FIG. 4A.

Referring to FIGS. 4A and 4B, in accordance with at least one aspect of this disclosure, a fuel injector fuel distributor system 201 can include a shroud 205 defining an interior cavity 207 and a liquid fuel distributor 203 defining a second interior cavity 213 disposed within an interior cavity 207 of the shroud 205. The liquid fuel distributor 203 is configured to form a liquid fuel distribution circuit 209 (e.g., with helical fuel channels as shown or any other suitable fuel channels) between the shroud 205 and the liquid fuel distributor 203.

The system 201 includes a gas fuel distributor 211 disposed within the interior cavity 213 of the shroud 205 and at least partially within the second interior cavity 213 of the liquid fuel distributor 203. The gas fuel distributor 211 is configured to form a gas fuel distribution circuit 215 (e.g., including helical gas fuel slots as shown or any other suitable flow channels) between the liquid fuel distributor 203 and the gas fuel distributor 211. The system 201 also includes a fuel transfer tube 217 including a liquid fuel channel 221 configured to be in fluid communication with the liquid fuel distribution circuit 209 and a gas fuel channel 223 configured to be in fluid communication with the gas fuel distribution circuit 215. At least one of the liquid fuel distributor 203, the gas fuel distributor 211, or the fuel transfer tube 217 is brazed or shrink fit to the shroud 205 (and/or attached in any other suitable as appreciated by those having ordinary skill in the art).

The liquid fuel distributor 203, the gas fuel distributor 211, and the fuel transfer tube 217 can all be brazed to the shroud 205, e.g., at one or more braze joints 225 as shown in FIG. 4B. As shown in FIG. 4B, the gas fuel distributor 211 and the liquid fuel distributor 203 can be press fit to the shroud 205 (e.g., to create a seal to form the respective fuel flow channels 209, 215). In certain embodiments, the gas fuel distributor 211 can be press fit to the liquid fuel distributor 203 (e.g., to create at least a portion of the gas fuel flow channel 215).

The system 201 can include a heat shield 227, e.g., as shown in FIG. 4B. The heat shield 227 as shown in FIG. 4B can be configured to expand and seal leak air between the gas fuel distributor 211 and the heat shield 227. The system 201 can include a spring seal 229 configured to seal against the downstream air mixer 231, which is hot in operation, and the relatively cold shroud 205, but to allow axial and/or radial movement of components due to growth thermal growth.

In accordance with at least one aspect of this disclosure, a fuel injector 200 for a turbomachine includes a fuel injector fuel distributor system 201 as described above. The turbomachine fuel injector 200 can be for an industrial turbomachine or any other suitable turbomachine. In certain embodiments, the fuel injector 200 can include a first fuel distributor 201 (e.g., a primary as shown on the left of FIG. 2 which can be associated with an igniter) and a second fuel distributor (e.g., a secondary as shown on the right of FIG. 2 and in FIGS. 3-4B which can be upstream of a larger combustor shroud).

Embodiments incorporate very large diameter fuel distributors (e.g., about 6 inches diameter and greater) capable of rapid mixing of either liquid or gas. Traditional nozzles utilized small diameter fuel injectors and depended on the combustor to mix fuel and air. Embodiments of a fuel injector in this design mixes very rapidly adjacent to the nozzle and reduce the work load of the combustor in adequately mixing fuel and air.

Dual fuel distributers can aid in properly distributing gas and/or liquid fuel around a large diameter. The fuel can be surrounded (both radially inward and radially outward) by air from radial air swirlers. Embodiments distribute fuel improve emissions and prevent hot spots which occur if fuel is biased to one side of the distributer.

Large diameter axial feed permits shrink/press fit to seal channels for liquid and gas. Embodiments are easily integrated with radial swirlers, e.g., in existing systems.

Any suitable combination(s) of any disclosed embodiments and/or any suitable portion(s) thereof is contemplated therein as appreciated by those having ordinary skill in the art.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A fuel injector fuel distributor system, comprising:

a shroud defining a first interior cavity;

a liquid fuel distributor defining a second interior cavity and disposed within the first interior cavity, the liquid fuel distributor configured to form a liquid fuel distribution circuit between the shroud and the liquid fuel distributor;

a gas fuel distributor disposed within the first interior cavity and at least partially within the second interior cavity, the gas fuel distributor configured to form a gas fuel distribution circuit between the liquid fuel distributor and the gas fuel distributor, the liquid fuel distributor and the gas fuel distributor positioned upstream of a combustor shroud, the combustor shroud forming a combustion chamber; and a fuel transfer tube including a liquid fuel channel configured to be in fluid communication with the liquid fuel distribution circuit and a gas fuel channel configured to be in fluid communication with the gas fuel distribution circuit, wherein at least one of the liquid fuel distributor, the gas fuel distributor, or the fuel transfer tube are brazed or shrink fit to the shroud, wherein the shroud and the combustor shroud form an annular wall enclosing the liquid fuel distributor, the gas fuel distributor, and the combustion chamber, wherein the fuel transfer tube extends through an outer diameter wall of the annular wall.

2. The system of claim 1, wherein the liquid fuel distributor, the gas fuel distributor, and the fuel transfer tube are all brazed to the shroud.

3. The system of claim 2, wherein the gas fuel distributor and the liquid fuel distributor are press fit to the shroud.

4. The system of claim 3, wherein the gas fuel distributor is press fit to the liquid fuel distributor.

5. A fuel injector for a turbomachine, comprising:

a fuel injector fuel distributor device, including:

a shroud defining a first interior cavity;

a liquid fuel distributor defining a second interior cavity and disposed within the first interior cavity such that a liquid fuel distribution circuit is formed between the shroud and the liquid fuel distributor;

a gas fuel distributor disposed within the first interior cavity and at least partially within the second interior cavity such that a gas fuel distribution circuit is formed between the liquid fuel distributor and the gas fuel distributor, the liquid fuel distributor and the gas fuel distributor positioned upstream of a combustor shroud forming a combustion chamber; and a fuel transfer tube including a liquid fuel channel configured to be in fluid communication with the liquid fuel distribution circuit and a gas fuel channel configured to be in fluid communication with the gas fuel distribution circuit, wherein at least one of the liquid fuel distributor, the gas fuel distributor, or the fuel transfer tube are brazed or shrink fit to the shroud, wherein the shroud and the combustor shroud form an annular wall enclosing the liquid fuel distributor, the gas fuel distributor, and the combustion chamber, wherein the fuel injector fuel distributor device extends through an outer diameter wall of the annular wall.

6. The injector of claim 5, wherein the liquid fuel distributor, the gas fuel distributor, and the fuel transfer tube are all brazed to the shroud.

7. The system of claim 6, wherein the gas fuel distributor and the liquid fuel distributor are press fit to the shroud.

8. The system of claim 7, wherein the gas fuel distributor is press fit to the liquid fuel distributor.

* * * * *